US006989222B2

(12) United States Patent
Shinjo et al.

(10) Patent No.: US 6,989,222 B2
(45) Date of Patent: Jan. 24, 2006

(54) LIQUID DEVELOPER, METHOD OF MANUFACTURING THE LIQUID DEVELOPER, AND IMAGE FORMING METHOD AND APPARATUS

(75) Inventors: Yasushi Shinjo, Kanagawa-Ken (JP); Atsuko Iida, Kanagawa-Ken (JP); Haruhi Oh-Oka, Kanagawa-Ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/722,512

(22) Filed: Nov. 28, 2003

(65) Prior Publication Data

US 2004/0106059 A1 Jun. 3, 2004

Related U.S. Application Data

(62) Division of application No. 10/023,768, filed on Dec. 21, 2001, now Pat. No. 6,689,526.

(30) Foreign Application Priority Data

Dec. 28, 2000 (JP) ..... 2000-402860

(51) Int. Cl.
*G03G 9/08* (2006.01)

(52) U.S. Cl. ..... 430/137.19; 430/137.22

(58) Field of Classification Search ..... 430/137.19, 430/137.22

See application file for complete search history.

(56) References Cited

U.S. PATENT DOCUMENTS 4,024,292 A * 5/1977 Lu et al. ..... 430/118
4,144,184 A 3/1979 Takahata et al.
4,202,785 A 5/1980 Merrill et al.
4,956,258 A 9/1990 Watanabe et al.
5,364,729 A * 11/1994 Kmiecik-Lawrynowicz et al. 430/137.14
5,409,795 A * 4/1995 Kato ..... 430/115

(Continued)

FOREIGN PATENT DOCUMENTS

JP 61093603 A * 5/1986

OTHER PUBLICATIONS

Diamond, Arthur S. (editor) Handbook of Imaging Materials. New York: Marcel-Dekker, Inc. (1991) pp. 231-236.*
Engloish translation of JP55-071713 (May 30, 1980).*
Diamond, Arthur S. (editor) Handbook of Imaging Materials, New York: Marcel-Dekker, Inc. (1991), pp. 232-239.
U.S. Appl. No. 10/948,145, filed Sep. 24, 2004, Shinjo, et al.

*Primary Examiner*—Christopher Rodee
(74) *Attorney, Agent, or Firm*—Oblon, Spivak, McClelland, Maier & Neustadt, P.C.

(57) ABSTRACT

A liquid developer, a method of manufacturing the same and a method and apparatus for forming an image, which can attain high transfer efficiency and appropriate tolerance to repetitive image formation. The liquid developer includes toner particles dispersed in an electrically non-conductive liquid solvent. Each toner particle has a resin particle, which is non-soluble in the liquid developer, and pigment particles formed on the surface of the resin particle, whereby the pigment particles suppress contact between the resin particles. Preferably the resin particles have a glass transition temperature of not less than room temperature. One example of manufacturing the liquid developer includes a step of milling pigment particles in a resin particles dispersion liquid at a process temperature higher than the glass transition temperature of the resin particles, whereby the pigments are formed on the surface of the resin particles.

16 Claims, 8 Drawing Sheets

U.S. PATENT DOCUMENTS 5,736,064 A 4/1998 Edamura et al.
5,981,134 A 11/1999 Miyamoto et al.
6,287,742 B1 * 9/2001 Yoon ..... 430/137.19
2002/0006571 A1 1/2002 Suda et al.

* cited by examiner

LIQUID DEVELOPER, METHOD OF MANUFACTURING THE LIQUID DEVELOPER, AND IMAGE FORMING METHOD AND APPARATUS

CROSS-REFERENCE TO RELATED APPLICATIONS

This a divisional application of U.S. application Ser. No. 10/023,768 filed on Dec. 21, 2001, now allowed.

This application claims the benefit of priority from Japanese patent Application No. 2000-402860, filed on Dec. 28, 2000, the entire contents of which are incorporated herein by reference.

BACKGROUND OF THE INVENTION

1. Field of the Invention

The present invention relates to a liquid developer, method of manufacturing the liquid developer, and image forming apparatus and method, such as an electrophotographic method, using the liquid developer.

2. Discussion of the Background

An electrophotographic toner image formed on a photosensitive body is preferably transferred to a receptor, such as a transfer roller, with high transfer efficiency. There are several transfer methods for transferring the toner image from the photosensitive body to the receptor using an electric field, heat, or pressure.

In the transfer method using the electric field, the transfer roller disposed in proximity or in contact with the photosensitive body at a transfer station is discharged by a corona discharger disposed inside of the transfer roller, whereby the transfer roller has an electric charge opposite to an electrical potential of toner particles on the photosensitive body and the transfer of toner images is accommodated. The transfer method using the electric field tends to be affected by an electrical resistance of the receptor and by process conditions, such as temperature and humidity.

In another transfer method applying a direct current bias between the photosensitive body and the receptor, electrons may be injected to the toner particles, whereby the toner image texture and transfer efficiency would be deteriorated. Transfer methods using the electric field or the direct current bias have such problems whether the processes are dry toner development processes or a liquid toner development processes.

The transfer method using heat or pressure achieves high efficiency and high texture transfer without being affected by temperature or humidity However it requires some devices, such as a release coating layer of high release characteristic formed on the photosensitive body.

The toner particles of liquid developer are usually expected to fix on a receptor at low temperature without using a fixing unit; therefore a glass transition temperature $T_g$ of resin which forms the toner particles is preferably below room temperature. However, such resin particles of low glass transition temperature $T_g$ have higher adhesion force.

The release characteristic of a release coating layer is deteriorated through consecutive usage and the resin particles of high adhesion force tends to remain on the deteriorated release coating layer, whereby a poor transfer was observed. The resin of low glass transition temperature $T_g$ also tends to be softer and resin particles deform to have a film shape under an applied pressure. The film shape forming toner particles may tend to stay on the photosensitive body, whereby occurrence of poor transfer may increase.

Toner particles including resin of a glass transition temperature $T_g$ higher than room temperature is disclosed in Japanese Patent Publication (Tokukou) 63-33141. The resin forming the toner particles is dissolved in a solvent, such as a chlorine-based solvent, and mixed with pigment. The pigment mixed resin is dispersed in a carrier solvent in which the resin cannot be dissolved and the dispersed particles comprising mixed resin and pigment are adjusted to form toner particles.

The thus formed toner particles tend to have smaller adhesion force than the toner particles having the glass transition temperature $T_g$ of lower than room temperature and also tend to retain their shape without changing to film-like shape. However, toner particles at a transfer station, where the photosensitive body and the receptor are pressed each other, receive high pressure during the transfer using heat and pressure. The resin particles forced to change its shape by the pressure tend to adhere to each other and form a toner film, whereby the image adheres to the photosensitive body and the transfer efficiency may decrease.

SUMMARY OF THE INVENTION

An object of the present invention is to provide a liquid developer, a method of manufacturing the liquid developer, and an image forming method using the liquid developer in which a high-resolution image can be obtained.

Another object of the present invention is to provide a liquid developer, and a method of manufacturing the same, whereby fine resolution and high electrical chargeability can be obtained. Although the liquid developer of the present invention is applicable to all transfer methods which are known in the art, the developer can maintain an initial characteristic through repetitious image forming process, such that the liquid developer of the present invention is specifically appropriate for an apparatus using at least a pressure or a heat transfer method.

In a first aspect of the present invention, there is provided a liquid developer including an electrically insulating solvent and a plurality of toner particles. Each of the plurality of toner particles includes resin particle and pigment particles, the resin particle being non-soluble to the electrically insulating solvent and the pigment particles being selectively formed on a surface of the resin particle.

In a second aspect of the present invention, there is provided a liquid developer including an electrically insulating solvent and a plurality of toner particles, each including a resin particle and pigment particles, the resin particle being non-soluble to the electrically insulating solvent, and the pigment particles being formed on a surface of the pigment particle, wherein a coverage rate of the surface of the resin particle by the pigment particles is 3.5% or more.

In a third aspect of the present invention, there is provided a liquid developer including an electrically insulating solvent and a plurality of toner particles, each including a resin particle and pigment particles, wherein the resin particle is non-soluble to the electric insulation solvent. Each of the toner particles includes a surface portion and an inside portion, and a first density of the pigment particles per unit volume of the resin particle at the surface portion is larger than a second density of the pigment particles per unit volume of the resin particle at the inside portion.

In a fourth aspect of the present invention, there is provided a method of manufacturing a liquid developer including preparing an electrically insulating solvent, adding a plurality of resin particles which are insoluble in the solvent and a plurality of pigment particles to the electrically insulating solvent, and milling the electrically insulating solvent with the plurality of resin particles and the plurality of pigment particles at a temperature not more than a glass transition temperature of the resin particles.

In a fifth aspect of the present invention, there is provided an image forming apparatus including a latent image retaining body, a developing unit, and an intermediate transfer medium. The developing unit is disposed adjacent to the latent image retaining body and configured to develop a latent image formed on the latent image retaining body using a liquid developer. The liquid developer includes an electric insulation solvent and a plurality of toner particles. Each of the plurality of toner particles contains a resin particle non-soluble in the electrically insulating solvent and pigment particles. Each of the toner particles includes a surface portion and an inside portion, and a first density of the pigment particles per unit volume of the resin particle at the surface portion is larger than a second density of the pigment particles per unit volume of the resin particle at the inside portion. The intermediate transfer body contacts the latent image retaining body at a transfer station and receives a pressure of about 0.5 kg/cm$^2$ to 50 kg/cm$^2$ from the latent image retaining body at the transfer station. The intermediate transfer body has a surface speed from about 80% to about 99% or from about 101% to about 120% of the surface speed of the latent image retaining body.

BRIEF DESCRIPTION OF THE DRAWINGS

A more complete appreciation of the invention and many of the attendant advantages thereof is readily obtained as the state becomes better understood by reference to the following detailed description when considered in connection with the accompanying drawings.

DETAILED DESCRIPTION OF THE EMBODIMENTS

Figure 1:
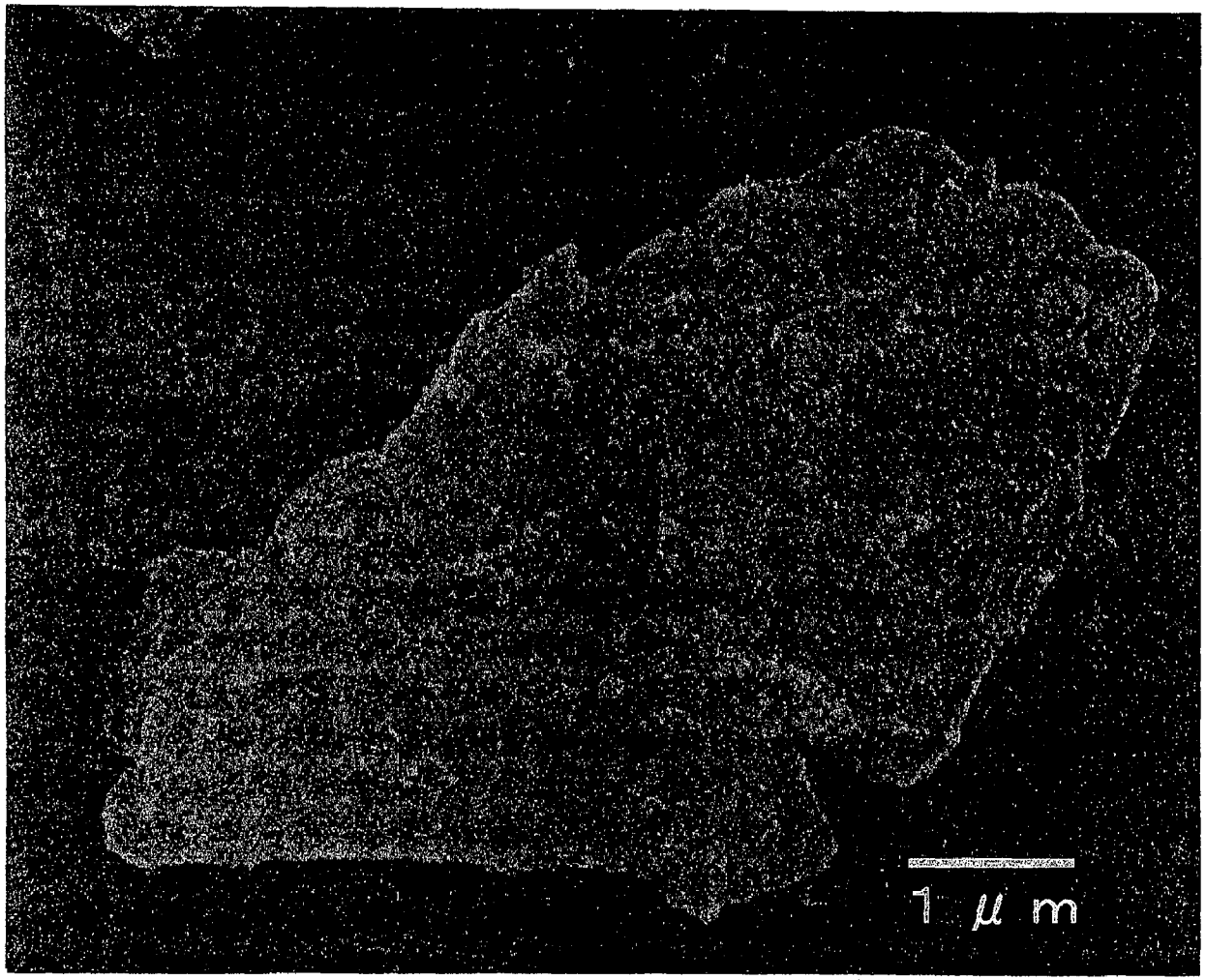
FIG. 1 is a photomicrograph taken with a scanning electron microscope (SEM) at a magnification of 15,000 times, showing a toner particle of a liquid developer according to a first example of the present invention.

In various aspects, the present invention relates to a liquid developer, a method for manufacturing the liquid developer, image forming apparatus and method using the liquid developer.

A liquid developer of a first embodiment of the present invention has a plurality of toner particles in a liquid solvent and the plurality of toner particles contain pigment particles and binder resin particle as main components.

Conventional toner particles are obtained through uniformly mixing pigments and binder resin, therefore the binder resin forms substantially large surface area of toner particles. The exposed surfaces of resin particles tend to adhere to each other when they contact, and the toner particles form film shape under an applied pressure and/or heating. It happens even though the resin's glass transition temperature $T_g$ is higher than an image forming process.

Japanese Patent Publication (Tokukou) No. 63-33141 describe a method of forming toner particles of a solvent-solved compound of pigment and resin. Even though the resin has a glass transition temperature of not less than room temperature, the toner particles of the solvent-solved compound have resin surfaces, and therefore also tend to form a film.

A first embodiment of the present invention provides a liquid developer having toner particles of a new physical structure wherein a substantial part of resin surface is covered with pigments, whereby resin surfaces of the toner particles are prohibited from adhering to each other through contact. To prevent the adhesion of the toner particles, the whole surface of each of the toner particles need not be covered with the pigments. For example, pigments having fibrous shape and lined up in substantially radial direction on the surface of resin particle may be an appropriate spacer between the resin particles of toner particles, whereby the different particles do not have resin surfaces which contact over a substantial amount of area.

A second embodiment of the present invention provides a method of manufacturing the liquid developer, including milling resin particles and pigments dispersed in a dispersion solvent at a temperature below a glass transition temperature of the resin particles, whereby the pigments preferably stick onto the surface of the resin particles. Prior to the milling, the pigments may be added into resin particles or a dispersion solvent in which the resin particles are dispersed, or the resin particles may be gradually added into a dispersion solvent in which pigment particles are dispersed.

The mixing temperature is preferably kept not higher than a glass transition temperature $T_g$ of resin particles, except a beginning stage of milling step, to keep the pigments fixed on the surface of the resin particles and not bury them inside the resin particles.

For the dispersion solvent, the solvent to which the resin particles are not soluble during the manufacturing process is appropriate. A non-polar dielectric solvent for the liquid developer may also be used as a solvent for the milling step of the pigments and resin particles, whereby it is unnecessary to substitute the dispersion solvent with a non-polar dielectric solvent of liquid developer during concentration adjustment of the liquid developer.

The volume of the dispersion solvent per weight of solid portion (pigments and resin particles) may range from about 2 L/kg to about 25 L/kg, (the weight of the solid portion per whole weight from about 5 to about 49 weight %) so as to prevent heat generation and attain high milling efficiency.

An average particle diameter of the resin may affect size of toner particles and resolution of developed image; therefore it may range from about 0.1 $\mu$m to about 5 $\mu$m.

An average particle diameter of a first stage pigment may be shorter than the average particle diameter of the resin and may range from about 1/250 to about 1/10 of the average particle diameter of the resin. During the milling step, the resin particles and the pigment particles are milled in a grinder or other known milling device for about 30 minutes or more, preferably for 120 minutes or more, whereby the pigment particles are pressed on surface of the resin particles to cover substantially the surface of the resin particles. The pressed pigments may be disposed on or partially lay under the surface of the resin particles.

A liquid developer was obtained through the above-described method using resin and pigment which are commercially available, and photographic images of the toner particles of FIGS. 1, 2, 3 and 4 were obtained by using a Scanning Electron Microscope (SEM). Specific description of method of manufacturing the liquid developer and an analysis of the photographic images will be explained in a following description of examples of the present invention.

Figure 5A:
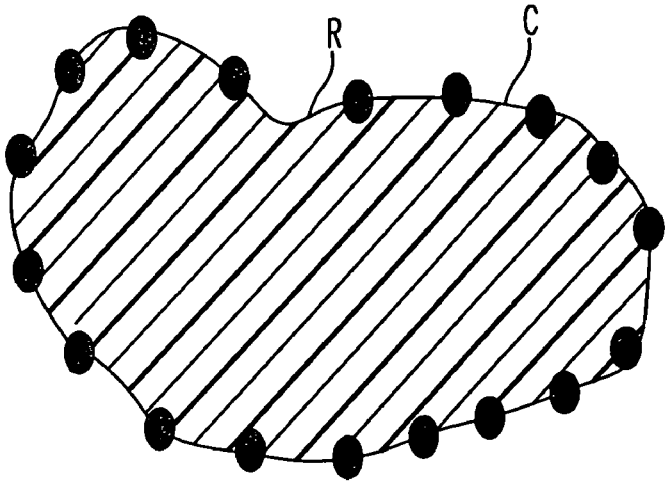
FIGS. 5A and 5B are schematic cross-sectional views of toner particles according to an embodiment of the present invention.

FIG. 5A is a schematic cross sectional view of toner particles. Pigment particles C of FIG. 5A are fixed on surface of the resin particle R and part of some of the pigment particles C lay under the surface of the resin particle R.

Figure 5B:
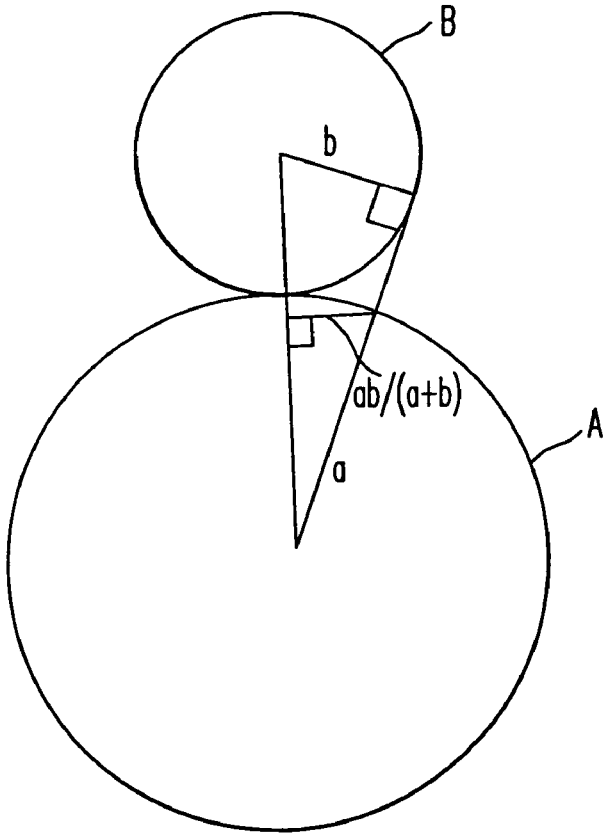

A surface coverage ratio of the resin particles by pigments can be obtained through a following approximation calculation. When the resin particles and pigment particles are supposed to have sphere shape of FIG. 5B, a projection area "Area" of pigment particle B on a resin particle A can be expressed by following equation (1), where "a" stands for an average radius of resin particle A and "b" stands for an average radius of pigment particles B.

$$\text{Area}=\pi(ab/(a+b))^2 \quad (1)$$

The coverage rate of resin particle A by one pigment particle B is expressed by a following equation (2).

$$\pi(ab/(a+b))^2/4\pi a^2=b^2/4(a+b)^2 \quad (2)$$

Therefore, a surface coverage rate θ of resin particle A by the plurality of pigment particles B is expressed by a following equation (3), where "$n_a$" stands for a specific gravity of resin particle A, "$n_b$" stands for a specific gravity of pigment particle B, and "K" stands for a weight ratio of pigment particles B to the resin particle A $$\theta=Kn_a a^3/[4n_b b(a+b)^2] \quad (3)$$

When θ is about 3.5% or more, the resin particle's surface contact was sufficiently prevented. Actual surface coverage rate of toner particles by pigment particles may be different from the calculated value θ because of a different manufacturing method or a break of particles during milling, but 3.5% may be used as a criterion. Furthermore, coverage rates in excess of 100% are possible, for example, by formation of one or more complete layers of the pigment particles on the resin (toner) particle surface. The coverage rates in excess of 100% imply there are also surplus pigment particles flowing in the liquid solvent besides the pigment particles formed on the resin particle. A Scanning Electron Microscope may be utilized to examine the toner particle's structure to adjust several conditions for the manufacturing process.

Several additional materials, described hereinafter, such as an electric charger, a wax and a liquid solvent, are added to the toner particles dispersion liquid to obtain appropriate toner particles concentration.

A resin having a glass transition temperature $T_g$ of less than a room temperature may also be used, however the resin having low glass transition temperature tends to change shape, therefore conditions for liquid developer manufacturing method using the resin of lower glass transition temperature $T_g$ might be stricter than using the resin of glass transition temperature $T_g$ of not less than room temperature. The room temperature of the liquid developer of the present invention ranges from around 15° Centigrade to 30° Centigrade according to the image forming process temperature and/or the liquid developer manufacturing temperature.

The resin of the embodiment may be any known material which is not soluble to the dispersion solvent, such as a nonconductive liquid solvent. Some different resin materials may be used and mixed. Some additional resin materials which are soluble to the dispersion solvent may be added as far as they do not affect the above described effect.

The preferred resin materials have a glass transition temperature $T_g$ of not less than a room temperature and not soluble in the solvent to be used. Specific examples are an acrylic based resin, a polyester based resin, an olefin based resin, etc. The liquid developer agent using a graft polymer as a non-moisture powder resin is described in Japanese Patent Applications Laid-open (Tokukai) Nos. 55-71713 and 55-90521. The disclosed graft polymer is described to have a polymer insoluble in an aliphatic hydrocarbon and a polymer soluble in the aliphatic hydrocarbon. One or more of the graft polymer materials may be used for the resin materials of the embodiments of the present invention. In case of the graft polymer, a glass transition temperature $T_g$ and total solubility of the resin may be a guide to chose.

As the non-polar dielectric liquid solvent of the embodiments of the present invention, organic solvents each having an electrical resistance of not less than $10^9$ Ω·cm and a dielectric constant of not more than 3, such as hexane, pentane, octane, nonane, deccan, undecane and dodecane, may be used. Other examples of the non-polar dielectric liquid solvent are aliphatic hydrocarbon solvents of a boiling point ranging from 68 to 250° Centigrade, such as ISOPARH®, ISOPARG®, ISOPARK®, ISOPARK®, and ISOPARM® sold by Exxon Chemical Ltd. Single or several aliphatic hydrocarbon solvents may also be used for the solvent of the embodiments of the present invention.

Conventional and well-known pigments and/or dyes may be used for colorant of the toner particles. Examples of the colorants are a carbon black, acetoacetic acid aryl amide based mono-azo yellow pigments such as C.I. Pigment Yellows Nos. 1, 3, 74, 97, and 98, acetoacetic acid aryl amide based dis-azo yellow pigments, such as C.I. Pigment Yellow Nos. 19, 77, and 79, Yellow Dyes such as C.I. solvent yellow Nos. 19, 77 and 79, and C.I. Disperse Yellow No. 164, red or vermilion pigments such as C.I. Pigment Red Nos. 48 and 49, C.I. Pigment Red Nos. 48, (49:1), (53:1), 57, (57:1), 81, 122, 5, and 146, red dyes, such as C.I. Solvent Red Nos. 49, 52, 58 and 8, blue based stain pigments of copper phthalocyanine, such as C.I. Pigment Blue Nos. (15:3) and (15:4) and their derivatives, and green pigments such as C.I. Pigment Green Nos. 7 and 36 (Phthalocyanine Green).

Single or several dyes or pigments are used as the colorant of the liquid developer of the embodiments of the present invention.

Known charge directors used for liquid developers may also optionally be added to the liquid developers of the embodiments of the present invention. Naphthenic acid cobalt salt, naphthenic acid copper salt, oleit acid copper salt, oleic acid cobalt salt, octyl acid zirconium salt, octyl acid cobalt salt, dodecylbenzenesulfonic acid calcium salt, soybean lecithin, aluminium octate, etc. may be used as the charge director.

The additional material such as wax may also be used for the liquid developers of the embodiments of the present invention. Examples of such additional materials are a paraffin wax, a polyethylene wax, a polypropylene wax, an ethylene copolymer, and a propylene copolymer.

Above described additional materials such as electrical chargers and waxes may be mixed in a binder resin prior to fixing of the colorant to the resin particles.

The above described liquid developers of the embodiments are used for an electrophotographic image forming apparatus in which an image is transferred from a photosensitive body to a receptor by using heat and/or pressure to the image or other transfer mechanism.

Figure 6:
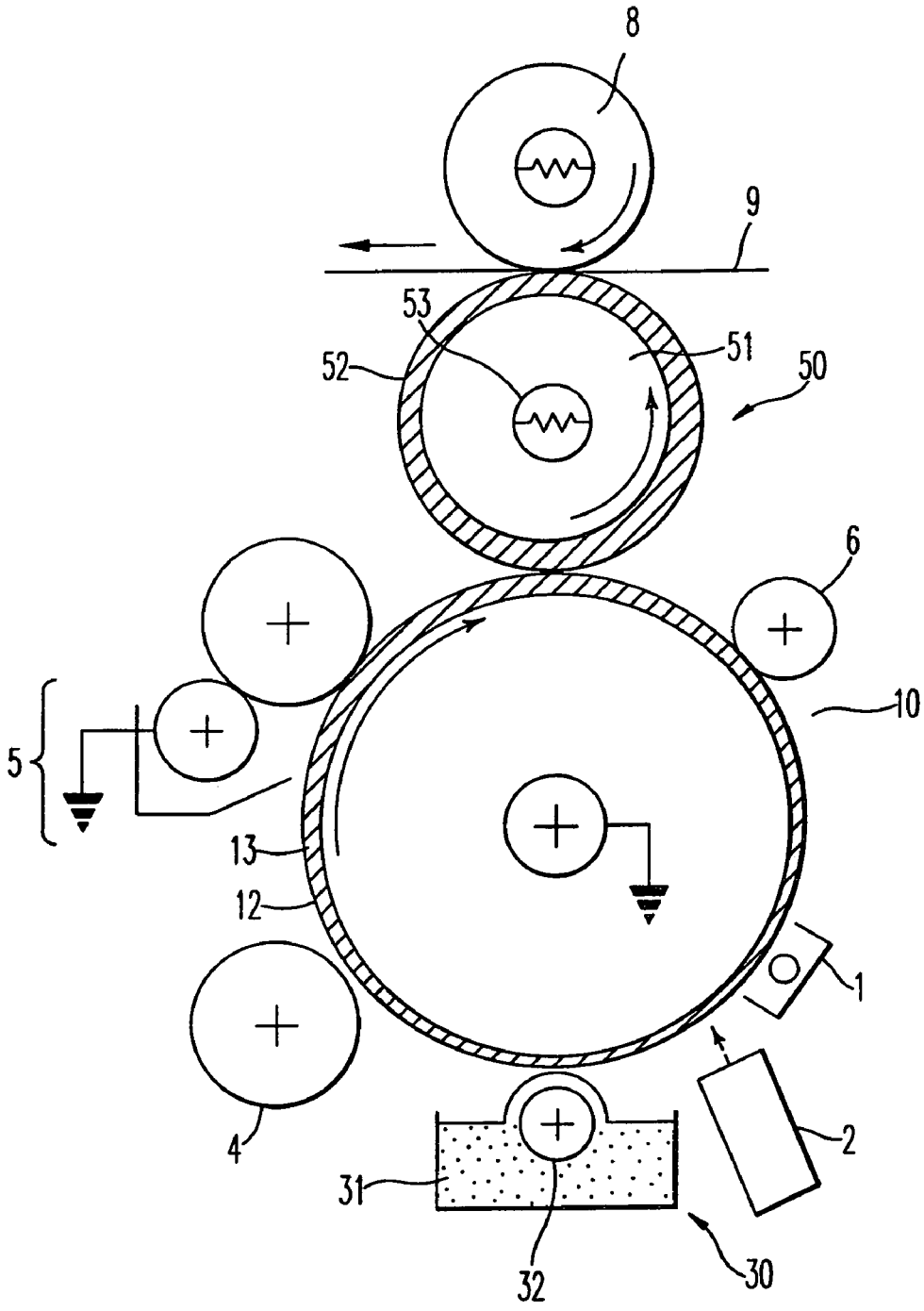
FIG. 6 is a cross-sectional view of an image forming apparatus according to an embodiment of the present invention.

FIG. 6 is a cross-sectional view of an image forming apparatus according to a third embodiment of the present invention.

The image forming apparatus of FIG. 6 comprises a latent image retaining body 10, such as an amorphous silicon photosensitive body 13 whose outer surface is covered with a release layer 12. The image forming apparatus of FIG. 6 also comprises a charger 1, a laser optical device 2, a developing unit 30, a squeezing roller 4, a solvent removing unit 5, an intermediate transfer body 50, and a back-up roller 8.

The charger 1 uniformly charges the latent image retaining body 10 and the laser optical device 2 forms a latent image by applying a laser beam to the latent image retaining body 10. The developing unit 30 has a developing roller 32 disposed adjacent to the latent image retaining body 10 with a predetermined gap therebetween. The developing roller 32 rotates and provides a liquid developer 31 in the developing unit 30 to the latent image retaining body 10, thereby to develop the latent image on the latent image retaining body 10 and form a toner adhered visible image on the latent image retaining body 10. Surplus liquid developer including solvent is squeezed by squeeze roller 4 from the surface of the latent image retaining body 10 and practically dried by the solvent removing unit 5. Through those solvent removal steps, substantial liquid portion is removed from the surface of latent image retaining body 10 except liquid compositions of the visible image portions.

The visible image on the latent image retaining body 10 is transferred by applying heat and pressure to the intermediate transfer body 50 and then transferred to a recording medium 9 by applying pressure from the back-up roller 8. After the transfer of the image, the surface of latent image retaining body 10 is cleaned by a cleaning roller 6.

The intermediate transfer medium 50 may receive a pressure from about 15 kg/cm$^2$ to about 20 kg/cm$^2$ from latent image retaining body 10 and also receive a pressure from about 7.5 kg/cm$^2$ to about 10 kg/cm$^2$ from the back-up roller 8. The latent image retaining body 10 may be arranged to have a surface speed at a first transfer station where the latent image retaining body 10 and the intermediate transfer body 50 faces each other and the visible image is transferred to the intermediate transfer body 50 from the latent image retaining body 10. The speed of the latent image retaining body 10 may be arranged to be faster than a surface speed of the intermediate transfer medium by a speed difference from about 2% to about 3%. The back-up roller 8 follows the rotation of the intermediate transfer body 50, whereby no difference occurs between surface speeds of the intermediate transfer body 50 and the latent image retaining body 10.

The application of the pressure and the speed difference between the intermediate transfer body 50 and the latent image retaining body 10 provides a shear pressure to the visible image at the first transfer station, thereby to improve transfer efficiency. The toner particles of the visible image at the first transfer station need to resist the shearing pressure and not to change shape but retain the film-like shape. The toner particles of the first embodiment of the present invention have resin particles of an appropriate solidity and pigment particles disposed on the surface of the resin particles to suppress adhesion force between the visible image and the latent image retaining body 10 at the first transfer station, whereby high transfer efficiency can be obtained.

The present invention also relates to a method of forming an image and transferring the image, described in relation to FIG. 6.

The electrical charger 1 of FIG. 6 uniformly charges the surface of latent image retaining body 10 up to about +750 V and the charged surface of the latent image retaining body 10 is exposed to a laser beam of about 600 dpi applied by the laser beam optical device 2, whereby the electrical potential of exposed surface of the latent image retaining body 10 is charged to about +100V. The developing roller 32 of stainless steel is disposed adjacent to the latent image retaining body 10. There may be a gap of about 100 $\mu$m between the surface of the developing roller 32 and the latent image retaining body 10. The latent image retaining body 10 rotates at about 220 mm/sec and the developing roller 32 rotates in an opposite direction at about 660 mm/sec so that both surfaces at a developing station moves in a same direction, whereby the liquid developer 31 is provided onto the latent image retaining body 10. The toner particles have an electrical positive charge and move from the developing roller, which has applied thereto an electrical potential of about +600 V, to the exposed region of the latent image retaining body 10 through electrophoretic action, whereby the latent images are developed to form a visible image.

The squeeze roller 4 of stainless steel is disposed adjacent to the latent image retaining body 10 with a gap of about 50 $\mu$m there between and rotates in the same direction as the rotation of latent image retaining body 10, whereby the surface of the squeeze roller at a squeeze station moves in an opposite direction relative to the surface movement of the latent image retaining body 10 so as to remove surplus liquid developer. The squeeze roller 4 may rotate at a speed of about 660 mm/sec. The solvent removing unit 5 removes additional liquid solvent from the latent image retaining body 10. The image moved through a solvent removing station may contain solvent from about 0 weight % to about 20 weight %. The solvent removing unit 5 may comprise a solvent suction porous urethane roller, an air-dry blower and/or equivalent devices.

The intermediate transfer medium 50 of FIG. 6 has a shaft 51 and a heater 53 attached to the shaft 51. The intermediate transfer medium 50 has a silicone rubber surface layer 52 having a thickness of about 200 $\mu$m. The heater heats the surface of intermediate transfer medium 50 up to about 80° Centigrade and the image at the first transfer station, whereby the image is transferred by an effect of pressure and heat from the latent image retaining body 10 to the silicone rubber surface layer 52.

The intermediate transfer medium 50 of FIG. 6 rotates at a surface speed of 213.4 mm/sec and the image on the intermediate transfer medium 50 is transferred to a recording medium, such as a paper, by using the back-up roller 8 which is heated up to about 80° Centrigrade by an inside heater 81 of FIG. 6. The back-up roller rotates in a same speed of the intermediate transfer medium 50.

According to the above-described process, a single visible image is formed on the recording substrate in each round of the latent image retaining body 10, the intermediate transfer roller 50, and the back-up roller 8. Alternatively, a multicolor image can be formed using several development units, each including the electrical charger 1, the exposing unit 2, the developing unit 30, and the squeeze roller 4 or their equivalent structures. The several development units repeat the development and produce in registration a multicolor image on the latent image retaining body 10 during one round of the latent image retaining body 10. Alternatively, each of several color developments can be performed during successive revolutions of the latent image retaining body 50, and in such case the electrical charger 1 and the optical exposing unit 2 can be commonly used to form each latent image prior to the development of the color images. The photosensitive body 10 and the intermediate transfer body 50 may have a belt sheet structure supported by two rollers disposed inside of the belt sheet. The intermediate transfer belt may have the inside rollers at the first and second transfer stations.

EXAMPLE 1

16 weight portions of polyester resin (NE-384 of Kao Corporation) of a specific gravity of 1.1 and 180 weight portion of a solvent (ISOPARL® of Exxon Chemical Ltd.) were put into a sand grinder and milled for about 2 hours at a speed of 1500 round/min, thereby a resin dispersion liquid having a solid percent of 8.16 weight % was obtained. During the milling step, the contents were water cooled to keep the contents' temperature lower than the glass transition temperature $T_g$ of resin so as not to plasticize the resin. The volume mean particle diameter of the dispersed resin was about 5 $\mu$m.

4 weight portions of phthalocyanine blue (KET BLUE No. 111 sold by Dainippon Ink Chemicals, Inc.) having an average primary diameter of about 50 nm and a specific gravity of 2.0 were added to the dispersed liquid solvent and the whole materials were milled for about 2 hours under the same conditions, thereby a colored resin particle dispersed liquid having a solid percent of about 10 weight % was obtained.

2 weight portions of naphthenic acid zirconium salt having 49 weight % of nonvolatile portion (Dainippon Ink and Chemicals, Incorporated) were added to 100 weight portions of the colored resin dispersed liquid, whereby a concentrated liquid developer having solid portion of about 10 weight % was obtained. The concentrated liquid developer was diluted to be about 10 times by adding ISOPERL® (Exxon Chemical Ltd.), whereby a cyan liquid developer was obtained. The cyan liquid developer had a zeta potential of about +85 mV (measured by a zeta electrical potential measuring apparatus) and a volume mean particle diameter of about 5 $\mu$m (measured by a diameter measuring apparatus).

Figure 2:
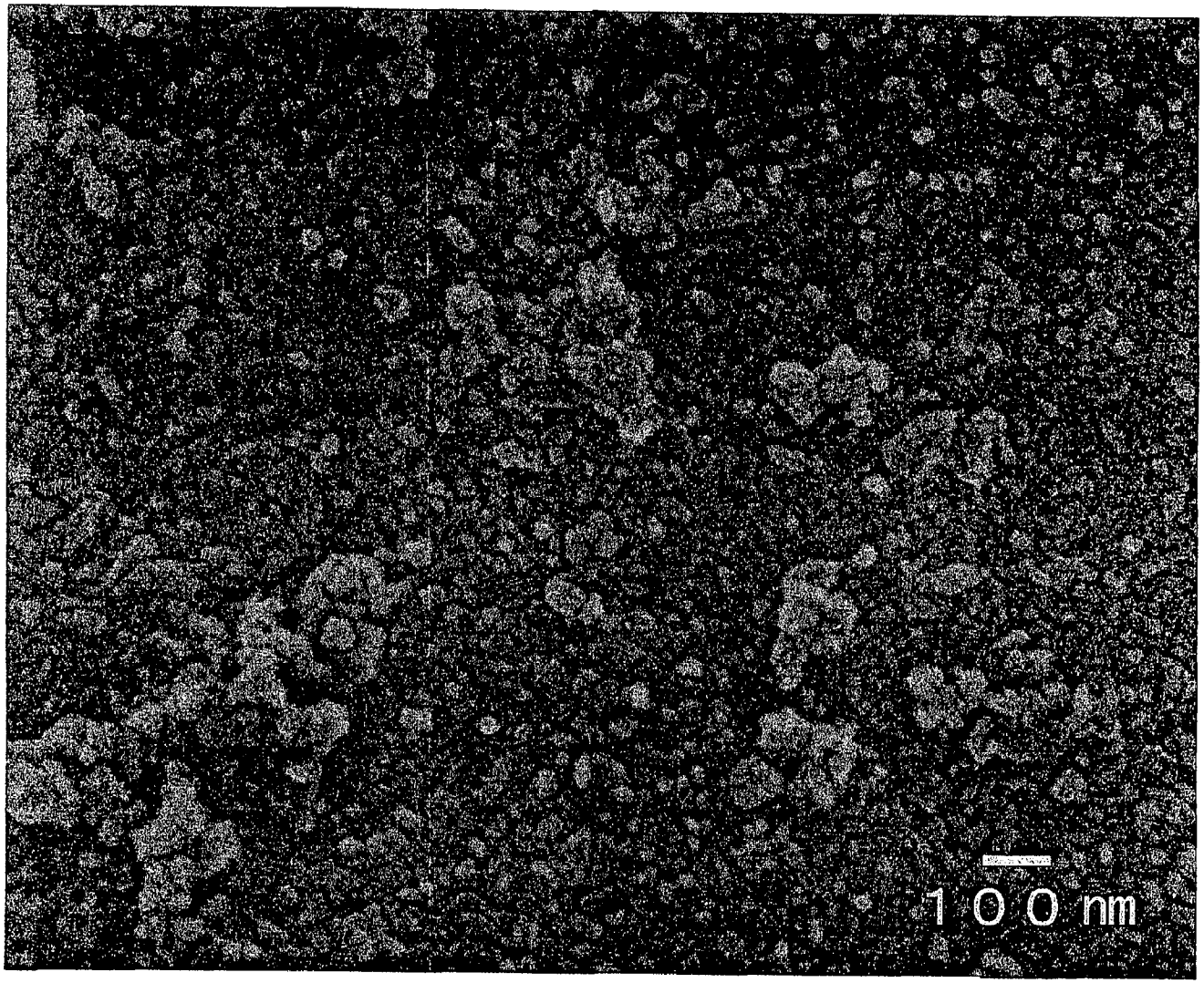
FIG. 2 is a SEM photomicrograph taken at a magnification of 60,000 times of a toner particle of the liquid developer according to the first example of the present invention.

FIGS. 1 and 2 are photomicrographs taken with a Scanning Electron Microscope, showing a toner particle(s) of liquid developer which is dried at room temperature. The photograph taken at a magnification of 15,000 times of FIG. 1 shows one toner particle having a diameter of almost 10 $\mu$m.

FIG. 2 is magnified photomicrograph of FIG. 1 and taken at a magnification of about 60,000 times, showing pigment particles formed on the surface of the resin particle. The pigments are observed as bright and each of the pigments has a diameter ranging from about 20 nm to about 200 nm.

As can be seen from FIGS. 1 and 2, the pigment particles were selectively formed on the resin particle's surface, i.e., substantially completely on the surface of the resin with little pigment being formed in the interior of the resin particle. As described above, if the milling temperature for mixing the toner particles is kept lower than the glass transition temperature of the resin, forming a substantial amount of pigment particles in the interior of the resin particle can be avoided. The calculated coverage rate of the resin particle by the pigment particles was 337%, where a resin particle's radius was about 5 $\mu$m and a pigment particle's radius was about 50 nm. However, the pigments actually gather each other and the actual coverage rate could be lower than the calculated rate.

An image formation was done by a following method using the liquid developer of example 1.

The surface of latent image retaining body 10 of FIG. 1 was electrically charged up to +750 V using the charger 1 and the charged surface of latent image retaining body 10 was exposed to the laser optical device 2 of 600 dpi. The electrical potential of exposed latent image retaining body 10 became about +100 V. A developing roller 32 was disposed to have a gap of 100 $\mu$m from the latent image retaining body 10 and arranged to have a surface speed of about 220 mm/sec.

A developing roller 32 was arranged to rotate in a direction different from that of the latent image retaining body 1 so that those surfaces at the developing station rotated in the same direction. The surface speed of the developing roller 32 was about triple that of latent image retaining body 10. The toner particles were charged to have a positive polarity and those moved to the exposed region of latent image retaining body 10 from the developing roller charged up to about +600 V.

The squeeze roller 4, made of stainless steel, was disposed to form a gap of about 50 $\mu$m from the image retaining body 10 and rotated in the same direction as the latent image retaining body 10 so that both surfaces at the squeeze station moved in opposite directions relative to each other. The surface speed of the squeeze roller 4 was about triple that of the latent image retaining body 1, whereby the squeeze roller removed the excess liquid solvent from the latent image retaining body 10. The solvent removing unit having a porous urethane roller additionally removed the liquid solvent on the latent image retaining body 10 so that the surface of the latent image retaining body, except regions supporting the image, was substantially dried. The image that contained liquid solvent of about 20 weight % was transferred to the intermediate transfer medium 50 using pressure and heat. The surface of intermediate transfer medium 50 was covered with a silicone rubber layer 52 that was heated up to about 80° C. The image on the intermediate transfer medium 50 was transferred to a paper receptor which was supported by the intermediate transfer medium 50 and the back-up roller 8.

10,000 images of 10% printed amount were continuously output on 10,000 sheets of recording paper of A4 size. Fine images were consistently obtained with complete image transfer, and transfer of solvent to the recording medium was not observed.

EXAMPLE 2

16 weight portions of styrene acrylate based resin (CPR-100 of Mitsui Chemicals) having a specific gravity of 1.1 and 180 weight portions of solvent (ISOPARL® of Exxon Chemical Ltd.) were mixed and milled under the same conditions as the first example and a resin dispersion liquid having solid portion of 8.16 weight % was obtained. The average diameter of the dispersed resin particles was about 1.5 $\mu$m. 4 weight portions of phthalocyanine blue (KRO of Sanyo Color Works, Ltd.) having a specific gravity of 2.0 and an average primary diameter of 50 nm were added to the liquid and milled for two hours under the same conditions as the first example, whereby a colored dispersed liquid having solid portion of 10 weight % was obtained.

2 weight portions of non-volatile naphthenic acid zirconium salt having a nonvolatile portion of 49 weight % (Dainippon Ink And Chemicals, Incorporated) were added to the 100 weight portions of colored dispersed liquid, whereby a concentrated liquid developer having a solid portion of about 10 weight % was obtained. A calculated coverage rate of each toner particle by the pigment particles was 97%, where an average diameter of resin particles was supposed to be 1.5 μm and an average diameter of pigments was supposed to be 50 nm.

The concentrated liquid was diluted by ten times with a solvent (ISPARL® of Exxon Chemical Ltd.) and a cyan liquid developer was obtained. A zeta electrical potential of the cyan liquid developer was measured by the zeta electrical potential measuring device (MATEC Applied Sciences; ESA-9800) and was +68 mV. A volume mean particle diameter of the toner particles was 1.5 μm.

Figure 3:
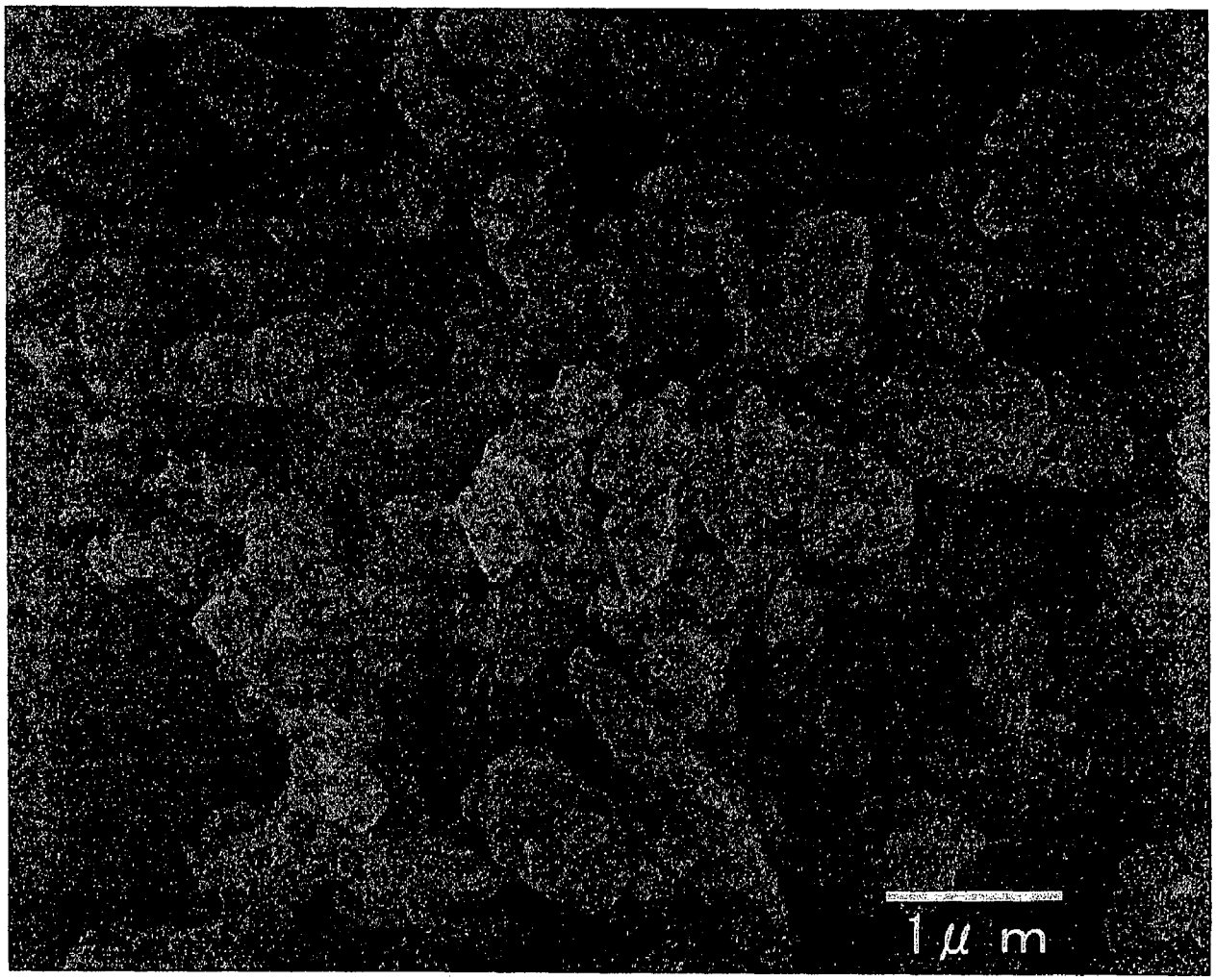
FIG. 3 is a SEM photomicrograph taken at a magnification of 15,000 times of toner particles of the liquid developer according to a second example of the present invention.
Figure 4:
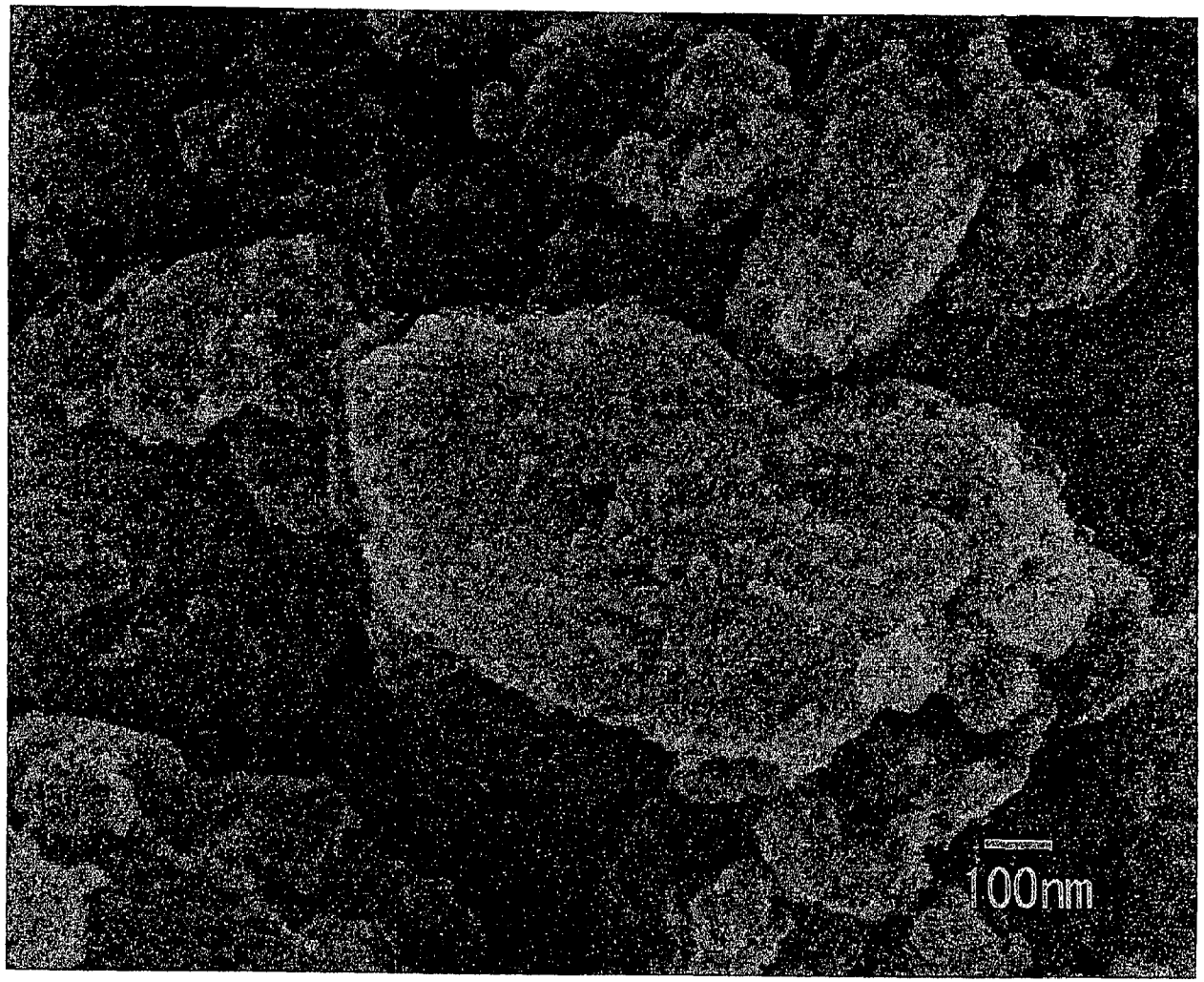
FIG. 4 is a SEM photomicrograph taken at a magnification of 60,000 times of toner particles of the liquid developer according to the second example of the present invention.

FIGS. 3 and 4 are SEM photomicrograph images of the toner particles of the dried liquid developer. The liquid developer was dried at room temperature and the toner particles were obtained. The image of FIG. 3 shows the toner particle at a magnification of 15,000 times. There are some toner particles having a diameter of less than 1 μm and some toner particles gathered each other.

The image of FIG. 4 shows toner particles at a magnification of 60,000 times. The pigments are observed bright in FIG. 4 and have an average diameter from about 20 nm to about 200 nm. The pigments are formed on the resin particles.

10,000 images of 10% printed amount continuously output on 10,000 recording paper sheets of A4 size using the liquid developer of the second example. Fine images were consistently with complete image transfer and transfer of solvent to the recording medium was not observed.

EXAMPLE 3

2 weight portions of phthalocyanine pigment used in the example 2 and 90 weight portions of a solvent (ISOPAR®) were added to 8 weight portions of fine particles of styrene acrylate (MP-5000 by Soken Chemical & Engineering Co., Ltd.), which has a specific gravity of about 1.1 and average diameter of about 0.4 μm, and those materials were put into a sand grinder and milled for about 2 hours at a speed of 2000 rounds per hour while a vessel of the sand grinder was water-cooled, whereby a colored resin particles dispersion liquid having a solid portion of about 10 weight % was obtained.

2 weight portions of naphthenic acid zirconium salt were added to 100 weight portions of the colored resin particles dispersion liquid, whereby a condensed liquid developer having a solid portion of 10 weight % was obtained.

An average coverage rate of a toner particle of the condensed liquid developer was 3.5%, where the resin particles were supposed to have an average diameter of about 0.4 μm and the pigment particles were supposed to have an average diameter of about 50 nm.

The condensed liquid developer was diluted by 10 times with a solvent (ISOPAR® of Exxon Chemical Ltd.), whereby a cyan liquid developer was obtained.

The obtained liquid developer had a zeta electrical potential of about +24 mV measured by the zeta electrical potential measuring device (MATEC Applied Sciences; ESA-9800) and the toner particles had a volume mean particle diameter of about 0.6 μm measured by the particle diameter meter (HORIBA; LA-920).

Figure 7:
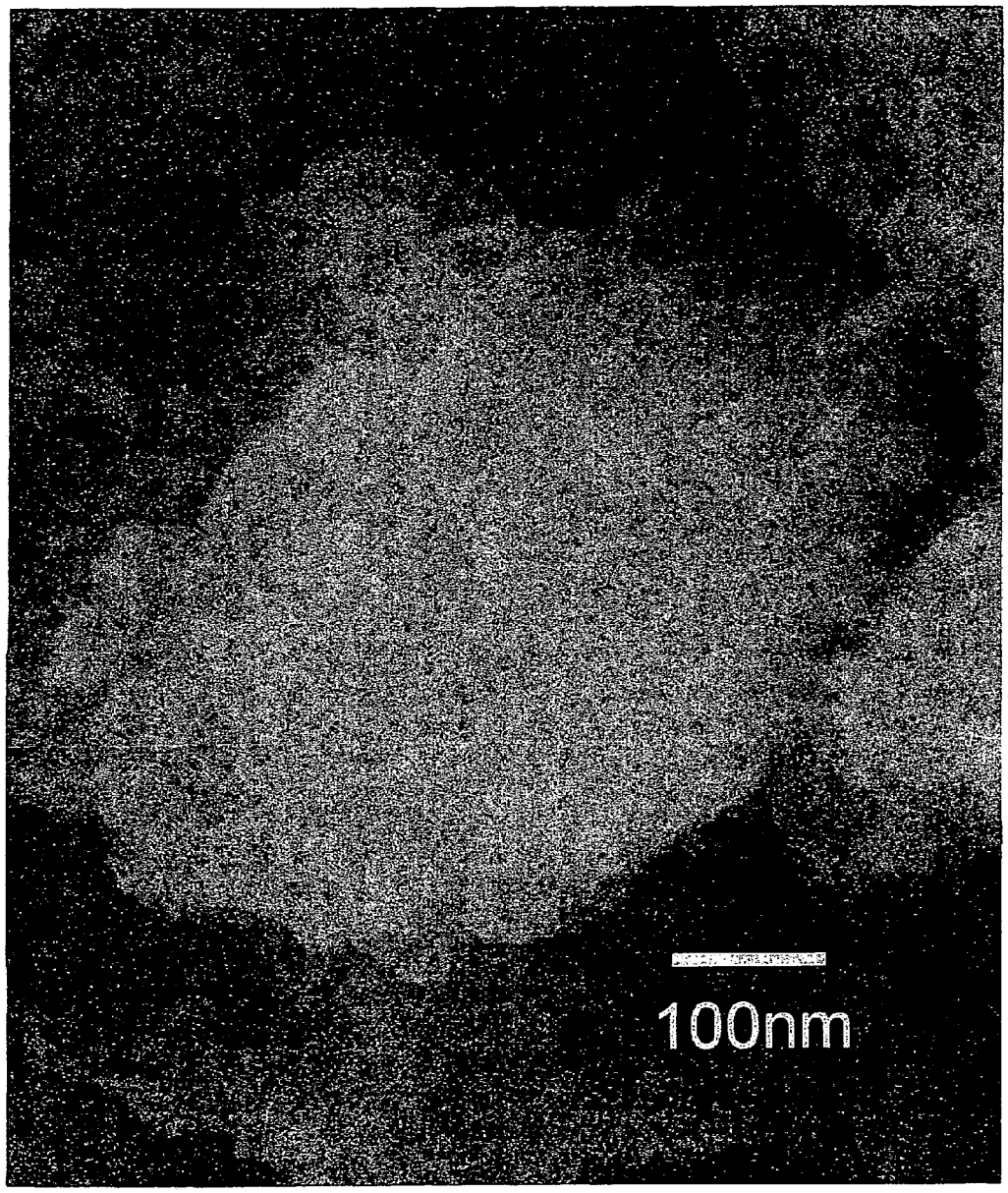
FIG. 7 is a SEM photomicrograph taken at a magnification of 100,000 times of toner particle of the liquid developer according to a third example of the present invention.

The liquid portion of the liquid developer was dried at room temperature, whereby toner particles were obtained. FIG. 7 is a photomicrograph image with a scanning electron microscope at a magnification of 100,000 times of the toner particle of the liquid developer. The pigment particles are gathered on a resin particle.

Figure 8:
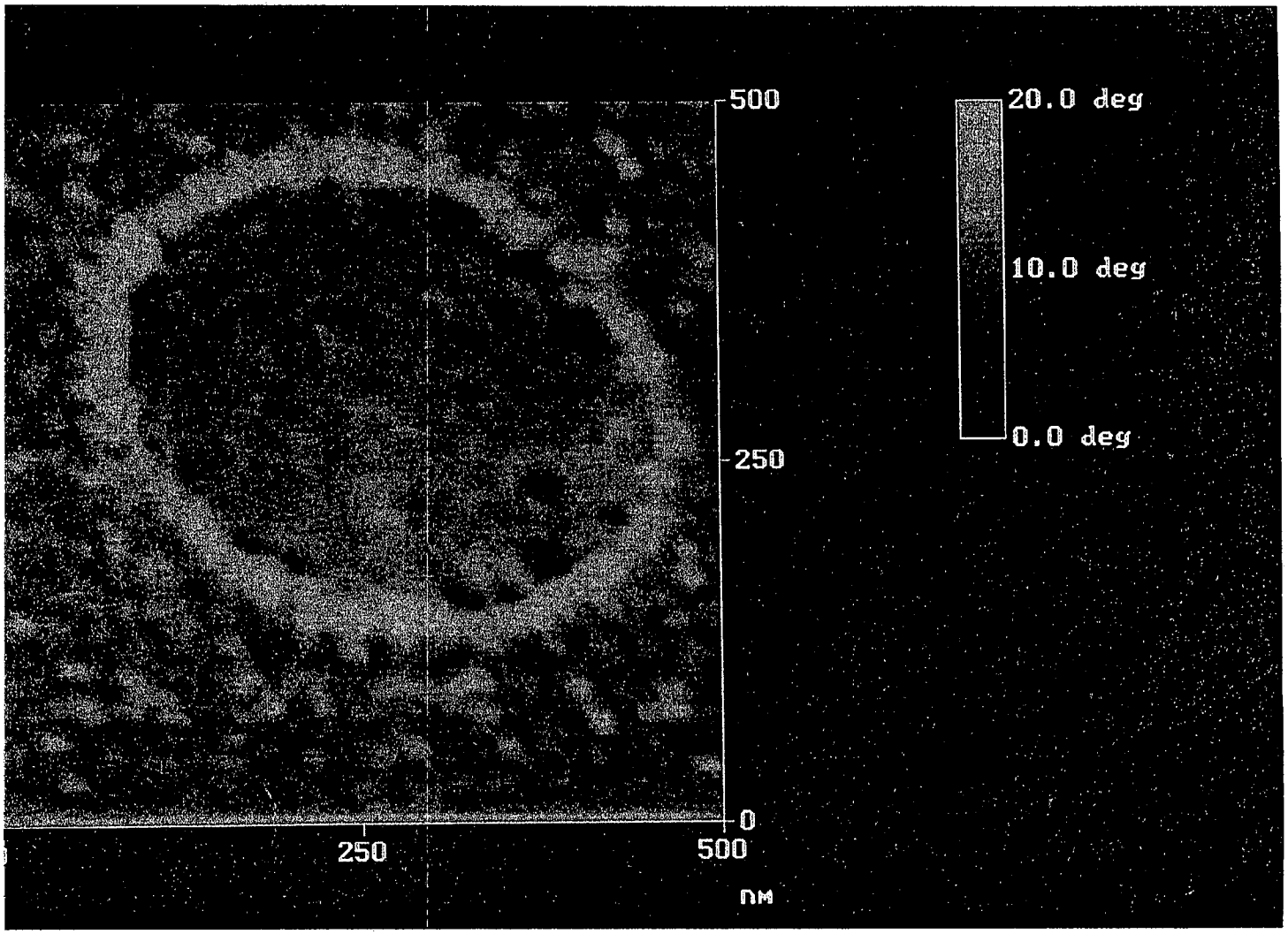
FIG. 8 is a micro-viscoelasticity distribution measurement taken with an atomic force microscope of the toner particles of FIG. 7.

FIG. 8 is a micro-viscoelasticity distribution measurement taken with contrast an atomic force microscope of the toner particle. Bright pigment particles whose phase ranges from about 12.0 deg to about 20.0 deg are formed and gathered on surface of the resin particle whose phase contrast ranges from 0.0 deg to about 10.0 deg. The phase contrast may change depending on measuring conditions, but an image taken with the atomic force microscope will give a distribution of the pigment particles of the toner particle.

The surface portion where the pigment particles gather has a thickness of from about 10 nm to 50 nm. The thickness of the surface portion may depend on a primary diameter and amount of pigment particles and may range from about 10 nm to about 1 μm.

The surface portion of the toner particle may have a thickness of about three times as the average diameter of the pigment particles and the inside portion of the toner particle may be the rest of the toner particle other than the surface portion.

As described above, liquid developers of the embodiments and examples according to the present invention are appropriate to obtain fine resolution and high electrical chargeability. The liquid developer of the present invention is applicable to all transfer methods which are known in the art, can maintain an initial characteristic through repetitious image forming, and this is particularly appropriate for an apparatus using as the transfer method pressure transfer or heat transfer.

Although the present invention has been particularly shown and described with reference to embodiments and examples thereof, it will be understood those skilled in the art that various other changes in the form and details may be made therein without departing from the spirit and scope of the invention.

What is claimed as new and desired to be secured by Letters Patent of the U.S. is:

1. A method of manufacturing a liquid developer, comprising steps of:

preparing an electrically insulating solvent;

adding to the electrically insulating solvent a plurality of resin particles insoluble in the electric insulation solvent and a plurality of colorant particles; and milling the electrically insulating solvent with the plurality of resin particles and the plurality of colorant particles at a temperature not more than a glass transition temperature of the resin particles, whereby a plurality of colorant particles form on the surface of each resin particle to such an extent that there is substantially no contact between individual resin particles, wherein the resin particle is made from a graft polymer.

2. The method of claim 1, further comprising a preliminary milling step performed before the milling step at the temperature not more than the glass transition temperature of the resin particle, the preliminary milling step being operated at a temperature higher than the glass transition temperature of the resin particle.

3. The method of claim 1, wherein the resin particles have a glass transition temperature of not less than room temperature.

4. The method of claim 1, wherein the resin particle is made from an acrylic based resin, a polyester based resin, or an olefin based resin.

5. The method of claim 1, wherein the electrically insulating solvent is at least one organic solvent selected from the group consisting of hexane, pentane, octane, nonane, decane, undecane and dodecane.

6. The method of claim 1, wherein the colorant particles are selected from the group consisting of black, yellow, red, vermillion, blue, and green particles, and mixtures thereof.

7. The method of claim 1, wherein the colorant particles are either black or a single color.

8. The method of claim 1, wherein the colorant particles are carbon black, acetoacetic acid aryl amide based monoazo yellow pigments, acetoacetic acid aryl amide based dis-azo yellow pigments, yellow dyes, red pigments, vermillion pigments, red dyes, blue based stain pigments of copper phthalocyanine or green pigments.

9. The method of claim 1, further comprising a step of adding a charge director to the electrically insulating solvent.

10. The method of claim 9, wherein the charge director is naphthenic acid zirconium, naphthenic acid cobalt salt, naphthenic acid copper salt, oleic acid copper salt, oleic acid cobalt salt, octyl acid zirconium salt, octyl acid cobalt salt, dodecylbenzenesulfonic acid calcium salt, soybean lecithin, or aluminum octane.

11. The method of claim 1, further comprising a step of adding a wax to the electrically insulating solvent.

12. The method of claim 11, wherein the wax is paraffin wax, polyethylene wax, polypropylene wax, ethylene copolymer, or propylene copolymer.

13. A method of manufacturing a liquid developer, comprising steps of:

preparing an electrically insulating solvent;

adding to the electrically insulating solvent a plurality of resin particles insoluble in the electric insulation solvent and a plurality of colorant particles; and forming the plurality of resin particles having the plurality of colorant particles stuck onto the surface of each of the resin particles, to such an extent that there is substantially no contact between individual resin particles, wherein the resin particle is made from a graft polymer.

14. The method of claim 13, further comprising a step of adding a charge director to the electrically insulating solvent.

15. A method of manufacturing a liquid developer, comprising steps of:

preparing an electrically insulating solvent;

adding to the electrically insulating solvent a plurality of resin particles insoluble in the electric insulation solvent and a plurality of colorant particles; and forming a surface portion and an inside portion of toner particles, a first density of the colorant particles per unit volume of the surface portion being larger than a second density of the colorant particles per unit volume of the inside portion, wherein the resin particle is made from a graft polymer.

16. The method of claim 15, further comprising a step of adding a charge director to the electrically insulating solvent.

* * * * *